US007988374B2

(12) United States Patent
Kohira

(10) Patent No.: US 7,988,374 B2
(45) Date of Patent: Aug. 2, 2011

(54) SHEET CUTTING DEVICE AND PRINTER

(75) Inventor: Hiroyuki Kohira, Chiba (JP)

(73) Assignee: Seiko Instruments Inc. (JP)

( * ) Notice: Subject to any disclaimer, the term of this patent is extended or adjusted under 35 U.S.C. 154(b) by 729 days.

(21) Appl. No.: 12/011,378

(22) Filed: Jan. 24, 2008

(65) Prior Publication Data

US 2008/0199239 A1 Aug. 21, 2008

(30) Foreign Application Priority Data

Feb. 8, 2007 (JP) ..... 2007-029082

(51) Int. Cl.
*B41J 11/00* (2006.01)
*B41J 29/02* (2006.01)

(52) U.S. Cl. ..... 400/621; 400/613; 83/614

(58) Field of Classification Search ..... 400/621, 400/611, 613, 693; 83/349, 614
See application file for complete search history.

(56) References Cited

U.S. PATENT DOCUMENTS

| | | | | |
|---|---|---|---|---|
| 6,447,187 | B1 | 9/2002 | Robinson | |
| 6,899,479 | B2 * | 5/2005 | Hayashi et al. | 400/621 |
| 2003/0103793 | A1 | 6/2003 | Murakoshi et al. | |
| 2004/0096256 | A1 | 5/2004 | Hayashi et al. | |
| 2004/0184863 | A1 * | 9/2004 | Mori et al. | 400/621 |
| 2005/0207818 | A1 | 9/2005 | Tsuchiya et al. | |

FOREIGN PATENT DOCUMENTS

| | | |
|---|---|---|
| EP | 0 999 530 A2 | 4/2000 |
| EP | 1 338 426 A1 | 8/2003 |
| EP | 1 445 113 A1 | 8/2004 |
| EP | 1 652 682 A1 | 5/2006 |

OTHER PUBLICATIONS

International Business Machines Corporation, "Paper cutting device incl. hinge mechanism", research disclosure, Dec. 1998, vol. 416, No. 158, Mason Publications, Hampshire, Great Britain.

* cited by examiner

*Primary Examiner* — Leslie J Evanisko
*Assistant Examiner* — Marissa L Ferguson-Samreth
(74) *Attorney, Agent, or Firm* — Adams & Wilks

(57) ABSTRACT

A printing device has a platen roller, a print head for printing on a sheet material, and a sheet cutting device for cutting the sheet material on which printing has been performed. The sheet cutting device has a stationary blade and a movable blade for cutting the sheet material in a pressing contact state with respect to the stationary blade. A release mechanism is disposed in the stationary blade frame and is movable to first and second positions to release the stationary and movable blades. In the first position of the release mechanism, the blades are in the pressing contact state, the platen roller is in contact with the print head, and ends of a platen roller shaft of the platen roller are disposed adjacent to one end of respective elongated holes of a stationary blade frame supporting the stationary blades. In the second position of the release mechanism, the blades are moved out of the pressing contact state, the platen roller is in contact with the print head, and the ends of the platen roller shaft are disposed adjacent to the other end of the respective elongated holes of the stationary blade frame.

12 Claims, 7 Drawing Sheets

SHEET CUTTING DEVICE AND PRINTER

BACKGROUND OF THE INVENTION

1. Field of the Invention

The present invention relates to a sheet cutting device for cutting a sheet material by a stationary blade and a movable blade after performing printing on the sheet material such as roll paper, and to a printer including the sheet cutting device.

2. Description of the Related Art

Conventionally, as a printer which performs printing on a sheet material in a form of roll paper, there exist a printing device for performing printing on the sheet material sandwiched between a print head and a platen roller, and a printer including a sheet cutting device for cutting the sheet material on which the printing has been performed by the printing device. As the sheet cutting device included in the printer of this type, there is known a sheet cutting device in which a movable blade moves with respect to a stationary blade, thereby cutting a sheet material.

In the related art sheet cutting device, when the sheet material is being cut, due to paper jam, the movable blade is disabled in some cases. In this case, it is necessary that the sheet material being an obstacle for an operation of the movable blade be removed. In order to achieve this, various structures are adopted, for separating the stationary blade and the movable blade from each other.

For example, there is disclosed a structure in which, when one of the print head and the platen roller, to which the print head is pressed, of the printing device is moved from a printing operation position to a release position for removing the sheet material, the one of the print head and the platen roller and one of the movable blade and the stationary blade are moved together (see, Patent Document 1).

Further, for another related art sheet cutting device, there is disclosed a structure in which the movable blade is mounted onto a side of a support portion for supporting a platen roller, and when the platen roller is moved to the release position spaced apart from the print head, a press contact state between the movable blade and the stationary blade and connection between the movable blade and a drive mechanism for moving the movable blade are released, and with a removal of the sheet material being the obstacle for the operation of the movable blade, the movable blade returns to a cutting stand-by position spaced apart from the stationary blade (see, Patent Document 2).

[Patent Document 1] JP 2002-219832 A

[Patent Document 2] JP 2004-237555 A

As disclosed in Patent Document 1, in the structure in which the stationary blade moves together with the print head or the platen roller, there is a risk of the print head or the platen roller being moved before a release operation in which the movable blade is moved with respect to the stationary blade to the cutting stand-by position. Further, there is a risk of the print head or the platen roller impacting on the movable blade which has not been completely moved to the cutting stand-by position. In order to prevent the impact between the movable blade and the print head or the platen roller, it is necessary that a space for moving the movable blade completely to the cutting stand-by position, that is, a space for ensuring a time for moving the movable blade to the cutting stand-by position be provided in the device. Thus, there is a problem in that the device as a whole is upsized.

Further, as disclosed in Patent Document 1, in a case of the structure in which the stationary blade or the movable blade is integrally moved together with the print head or the platen roller, a moving direction in which the print head and the platen roller are spaced apart from each other is regulated, so there is a problem in that an opening and closing direction with respect to a device main body is limited.

In a structure disclosed in Patent Document 2, there is required a retaining mechanism for a movable blade unit, formed of a separate member such as a cover or the like for a casing, for example, and a cutting operation cannot be performed by the printer alone. Accordingly, in a device of an automatic sheet insertion mechanism type, which does not require attachment and detachment of the print head or the platen roller of a printing portion, there is a problem of upsizing the device as a whole.

Further, also in the device of the automatic sheet insertion mechanism type as described above, when the sheet material is removed at the time of the paper jam in the printer, it is necessary that the print head or the platen roller of the printing portion be detachable.

SUMMARY OF THE INVENTION

It is therefore an object of the present invention to provide a sheet cutting device and a printer enabling easy elimination of a sheet material inhibiting an operation of a movable blade at a time of paper jam, and capable of downsizing the device as a whole.

In order to achieve the above-mentioned object, according to the present invention, in a sheet cutting device having a stationary blade, which is disposed on a downstream side in a transporting direction of a sheet material with respect to printing means, for performing printing on the sheet material, a movable blade, which is moved to be close to and spaced apart from the stationary blade, for cutting the sheet material in a press contact state with respect to the stationary blade, and drive means for moving the movable blade with respect to the stationary blade, the stationary blade being disposed on the downstream side in the transporting direction of the sheet material with respect to the movable blade, the sheet cutting device includes: a stationary blade frame for supporting the stationary blade; a movable blade frame for supporting the movable blade; and a main frame which movably supports the stationary blade frame, and to which the movable blade frame is fixed. The stationary blade frame is provided movably with respect to the main frame so that the stationary blade is moved to a release position, where the press contact state between the stationary blade and the movable blade is released while retaining a position of the printing means.

In the sheet cutting device according to the present invention structured as described above, during cutting of the sheet material, when the movable blade is disabled due to the paper jam, while the position of the printing means is retained, the stationary blade frame is moved with respect to the main frame and the stationary blade frame is moved with respect to the main frame, thereby moving the stationary blade to the release position where the press contact state between the stationary blade and the movable blade is released. Further, in the sheet cutting device, when the movable blade is disabled due to the paper jam, while the position of the printing means is retained, the stationary blade frame is moved with respect to the main frame, thereby moving the stationary blade to the release position, and the movable blade is moved to a cutting stand-by position. Accordingly, when the stationary blade is moved together with the printing means as in the related art, the printing means is reliably prevented from impacting on the movable blade. Therefore, unlike in the related art device, in the sheet cutting device, it is not necessary to provide therein a space for ensuring a time for moving the movable blade to the cutting stand-by position, so the device is downsized as a whole.

Further, a moving member included in the sheet cutting device according to the present invention preferably includes a press contact member for bringing the stationary blade into press contact with the movable blade, and by a relatively simple structure, the stationary blade frame can be moved with respect to the main frame.

Further, each of the main frame and the stationary blade frame included in the sheet cutting device according to the present invention is preferably provided with positioning means for positioning the stationary blade frame with respect to the main frame. With this structure, the stationary blade frame can be reliably positioned in a predetermined position with respect to the main frame. Accordingly, there is no need of a separate member, and the cutting by the sheet cutting device alone is enabled.

Further, the sheet cutting device according to the present invention preferably includes transmission releasing means for disconnecting the movable blade and the drive means from each other when the stationary blade frame is moved with respect to the main frame. With this structure, the movable blade can be easily moved to the cutting stand-by position spaced apart from the stationary blade side.

Further, the stationary blade frame included in the sheet cutting device according to the present invention may be detachably provided to the main frame.

Further, according to the present invention, in a sheet cutting device having a stationary blade, which is disposed on a downstream side in a transporting direction of a sheet material with respect to printing means, for performing printing on the sheet material, a movable blade, which is moved to be close to and spaced apart from the stationary blade, for cutting the sheet material in a press contact state with respect to the stationary blade, and drive means for moving the movable blade with respect to the stationary blade, the movable blade being disposed on the downstream side in the transporting direction of the sheet material with respect to the stationary blade, the sheet cutting device includes: a stationary blade frame for supporting the stationary blade; a movable blade frame for supporting the movable blade; and a main frame which movably supports the movable blade frame, and to which the stationary blade frame is fixed. Further, the movable blade frame is provided movably with respect to the main frame so that the movable blade is moved to a release position, where the press contact state between the stationary blade and the movable blade is released while retaining a position of the printing means.

Further, a printer according to the present invention includes: the sheet cutting device of the present invention described above; and printing means for performing printing on the sheet material.

As described above, according to the present invention, the stationary blade frame or the movable blade frame is provided so as to be movable with respect to the main frame while the position of the printing means is retained, thereby enabling easy and reliable elimination of the sheet material inhibiting the operation of the movable blade at the time of paper jam and making it possible to downsize the device as a whole.

DETAILED DESCRIPTION OF THE PREFERRED EMBODIMENT

Hereinafter, a specific embodiment of the present invention will be described with reference to the drawings.

A printer according to this embodiment is a printer in which printing is performed on the sheet material, and the sheet material is then cut to have a predetermined length, and in which a stationary blade frame is attached to a detachable platen roller of a printing device. For the sheet material used in the printer of this embodiment, there is employed so-called heat sensitive paper having a heat-sensitive printing layer provided on a surface side of a sheet-like base material.

Figure 1:
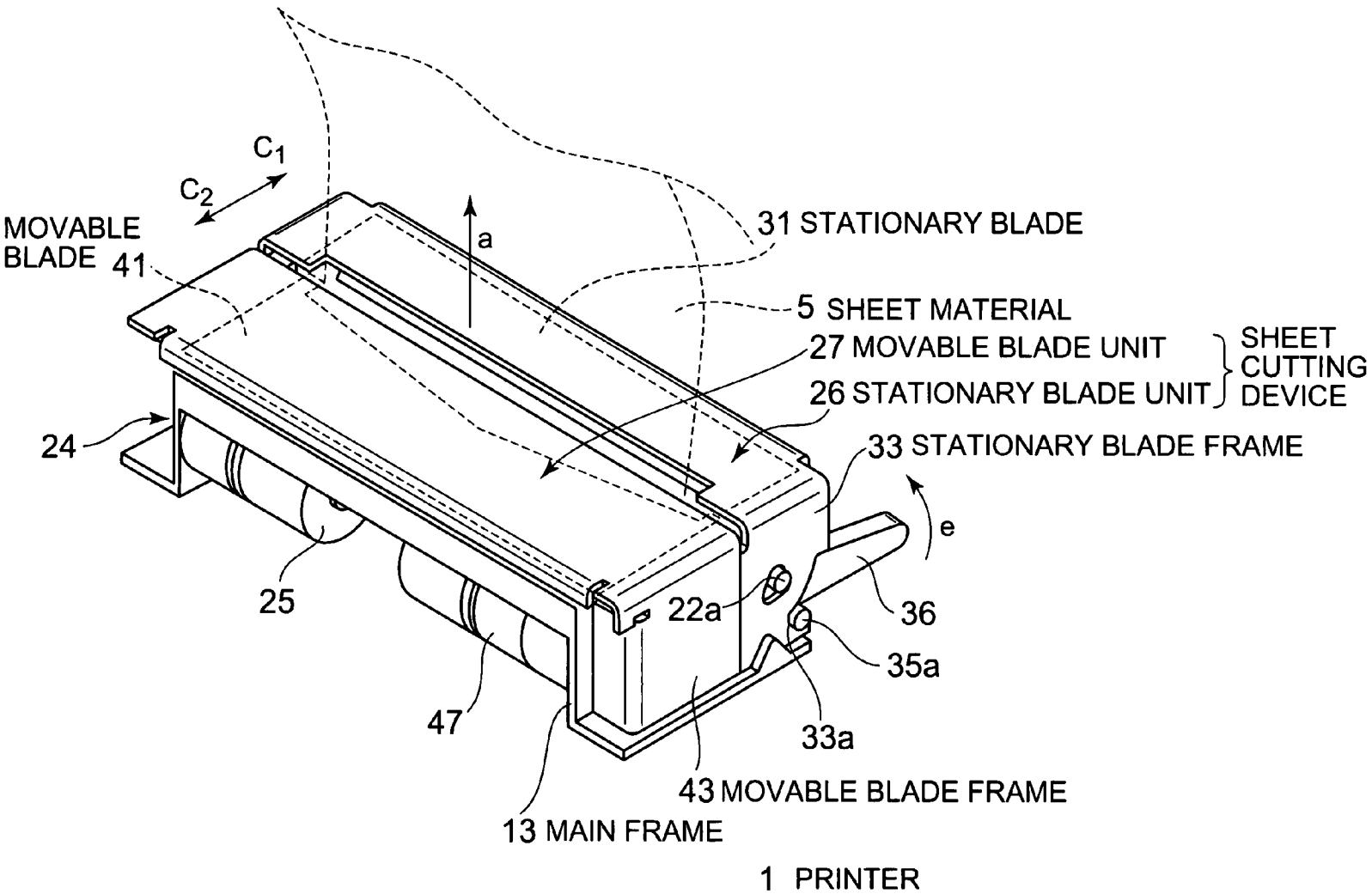
FIG. 1 is a perspective view showing a printer of an embodiment of the present invention.
Figure 2:
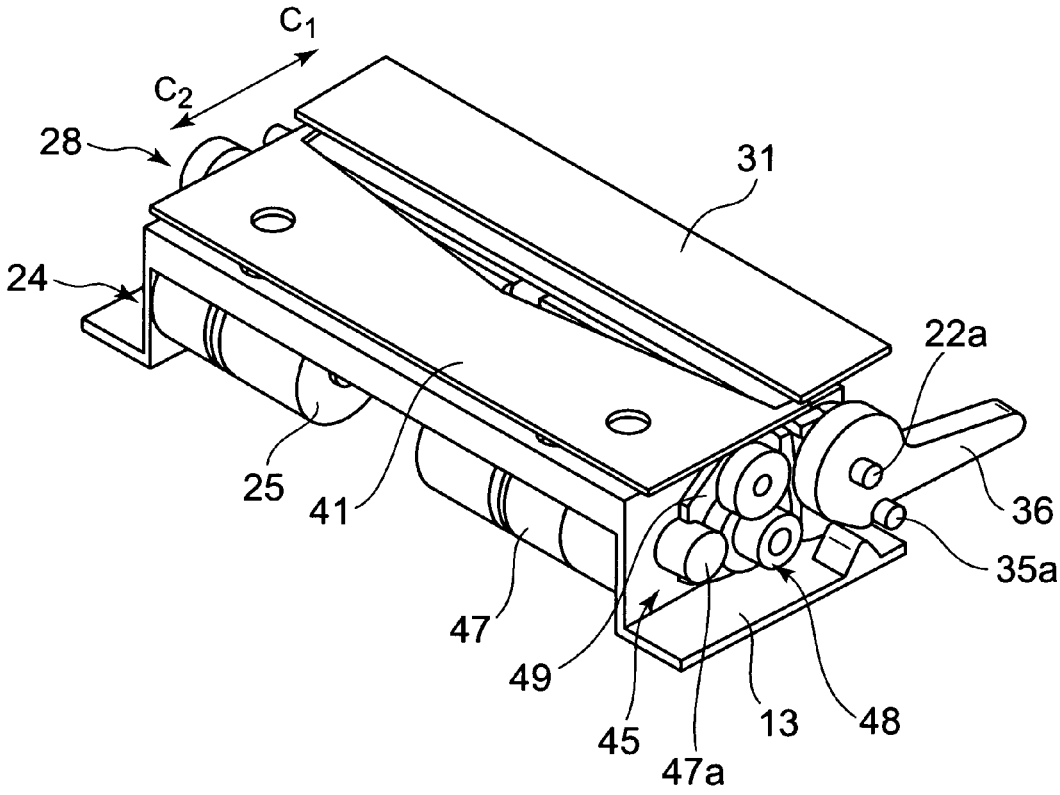
FIG. 2 is a perspective view showing a sheet cutting device with a movable blade frame and a stationary blade frame being omitted.
Figure 3:
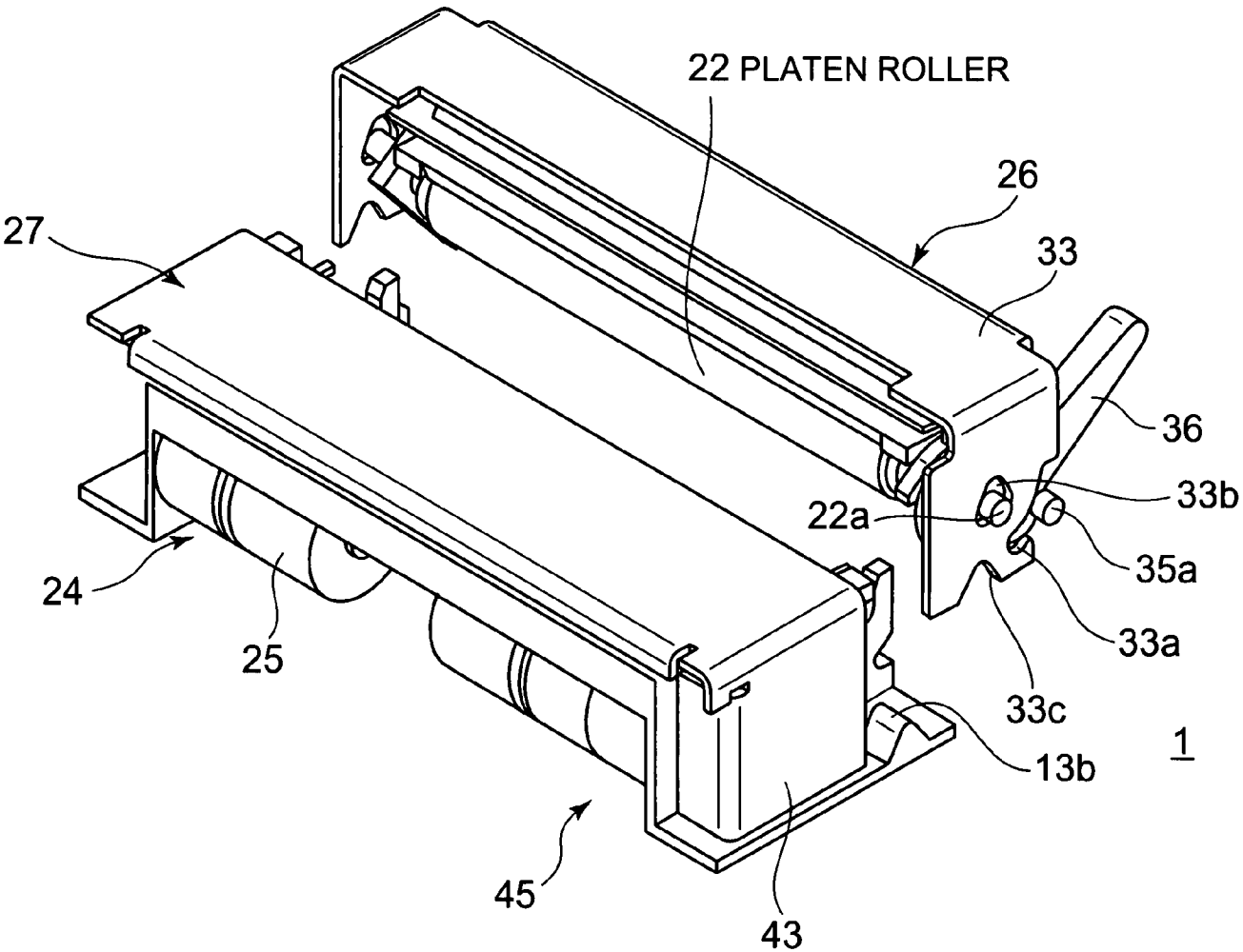
FIG. 3 is a perspective view showing a state in which a stationary blade unit is removed from a main frame of the sheet cutting device.
Figure 4:
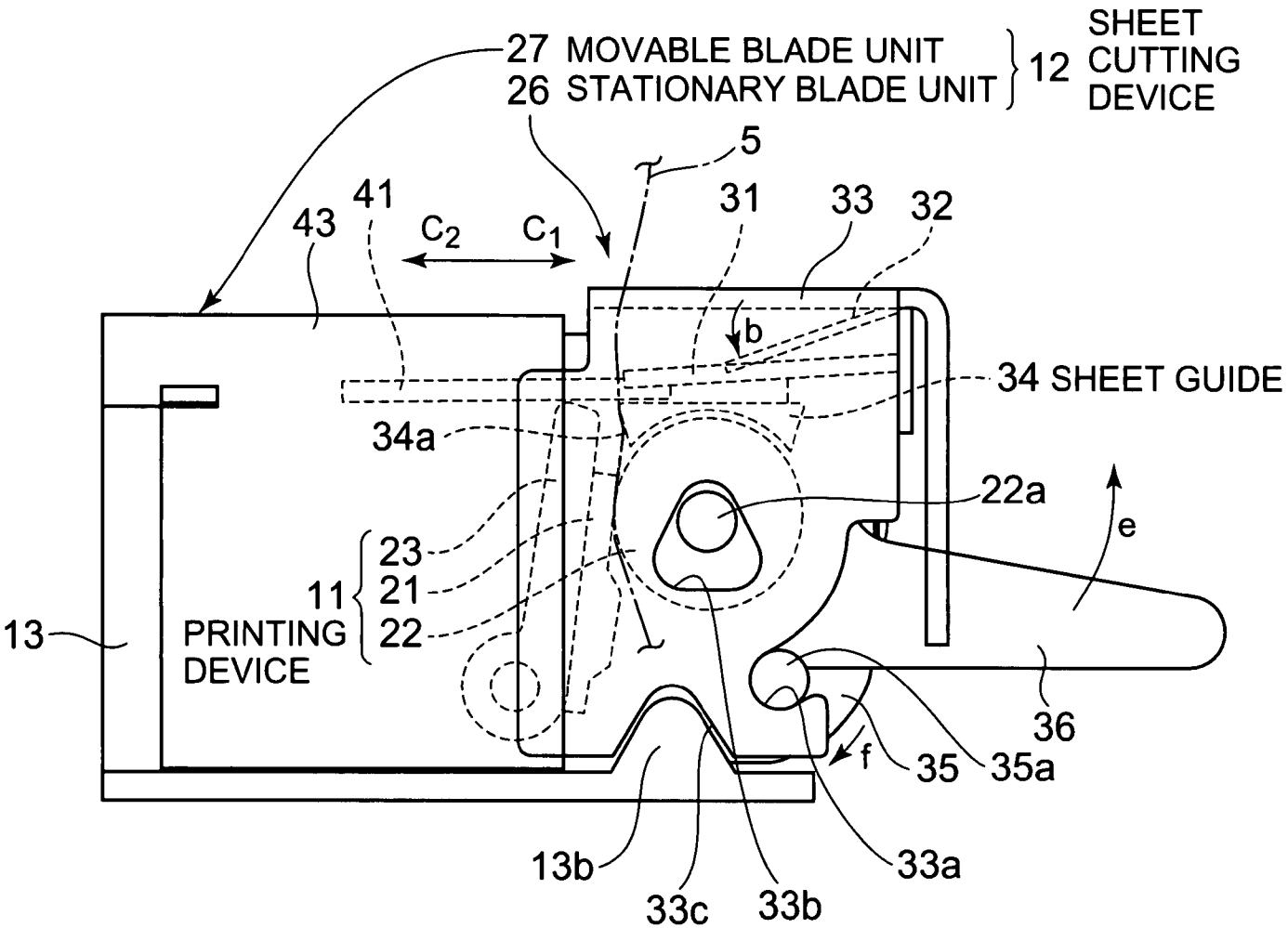
FIG. 4 is a see-through side view showing a state where the stationary blade unit is positioned with respect to the main frame of the sheet cutting device.
Figure 5:
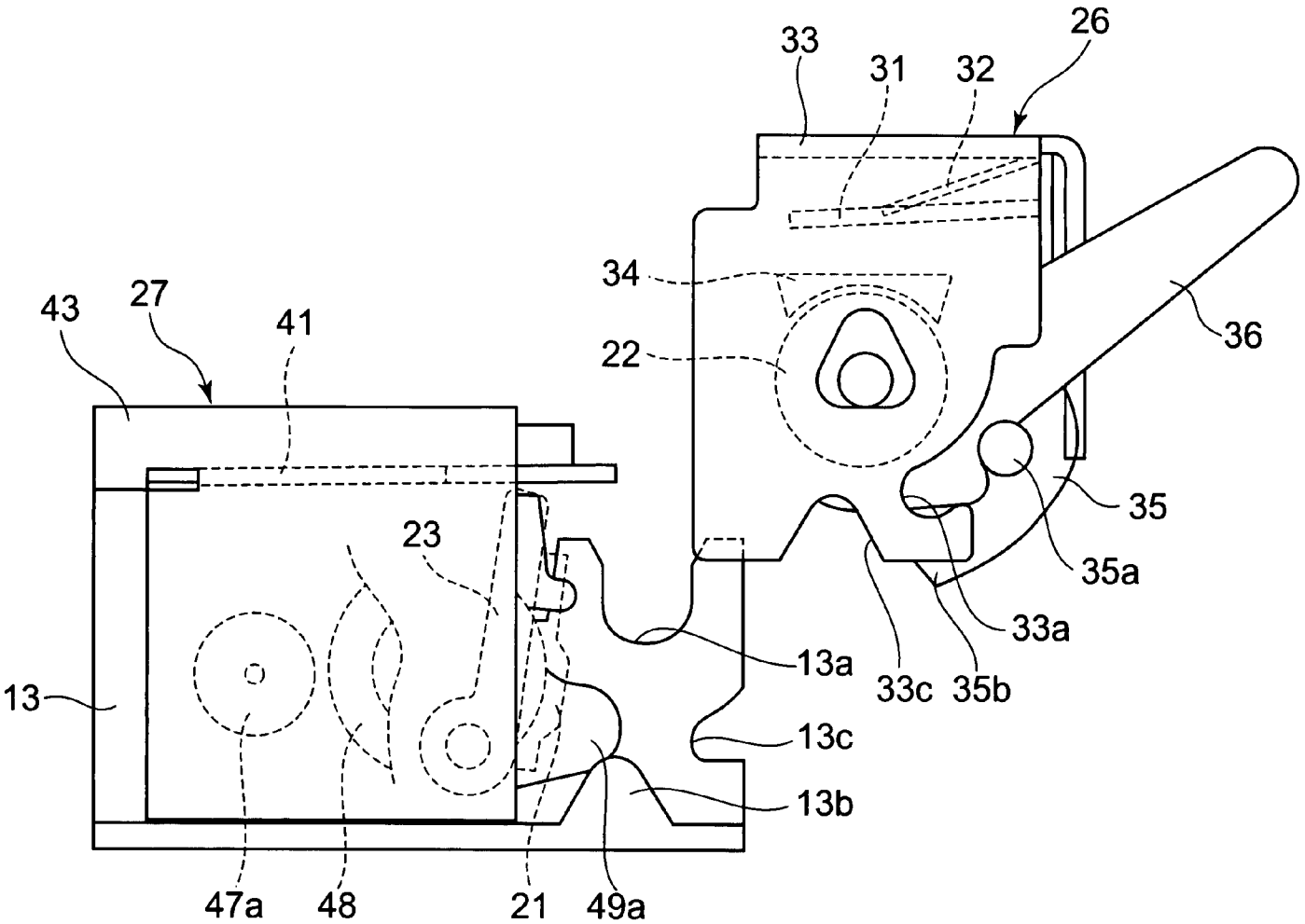
FIG. 5 is a see-through side view showing a state where the stationary blade unit is removed from the main frame.

FIG. 1 is a perspective view showing a printer of this embodiment. FIG. 2 is a perspective view of a sheet cutting device with a movable blade frame and the stationary blade frame being omitted. FIG. 3 is a perspective view showing a state in which a stationary blade unit is removed from a main frame of the sheet cutting device. FIG. 4 is a see-through side view showing a state where the stationary blade unit is positioned with respect to the main frame. FIG. 5 is a see-through side view showing a state where the stationary blade unit is removed from the main frame.

As shown in FIGS. 1 and 4, a printer 1 of this embodiment includes a printing device 11 for performing printing on a sheet material 5 and transporting the sheet material 5 in a direction indicated by an arrow a of FIG. 1, a sheet cutting device 12 for cutting the sheet material 5 on which printing has been performed by the printing device 11, and a main frame 13 for supporting the printing device 11 and the sheet cutting device 12.

The printing device 11 included in the printer 1 of this embodiment includes, as shown in FIGS. 3 and 4, a print head 21 for heating a heat-sensitive printing layer of the sheet material 5 to develop a color, a platen roller 22 with which the print head 21 is brought into press contact, a head supporting body 23 for supporting the print head 21, a compression coil spring (not shown) for pressing the head supporting body 23 to the platen roller 22, and a platen roller drive mechanism 24 for rotating the platen roller 22.

Further, as shown in FIG. 4, the head supporting body 23 of the printing device 11 is movably supported by the main frame 13, and by a biasing force of the compression coil spring, the print head 21 is brought into press contact with a peripheral surface of the platen roller 22.

Further, as shown in FIG. 2, the platen roller drive mechanism 24 of the printing device 11 includes a print drive motor 25, and a gear train 28 for transmitting a driving force by the print drive motor 25 to the platen roller 22. The print drive motor 25 and the gear train 28 are supported by a side plate of the main frame 13.

The sheet cutting device 12 included in the printer 1 includes, as shown in FIG. 1, a stationary blade unit 26 having a stationary blade 31 and a movable blade unit 27 having a movable blade 41.

The stationary blade unit 26 of the sheet cutting device 12 includes, as shown in FIG. 4, the stationary blade 31, a plate spring 32 (press contact member) for bringing the stationary blade 31 into press contact with the movable blade 41, a stationary blade frame 33 for supporting the stationary blade 31, a sheet guide 34 for supporting the sheet material 5 which is transported in the direction of the arrow a, a lock member 35 for regulating a position of the stationary blade frame 33 with respect to the main frame 13, and a release lever 36 for releasing a locking state of the stationary blade frame 33 by the lock member 35.

The stationary blade 31 of the stationary blade unit 26 is made of a flat plate-like material as shown in FIG. 2, and a blade edge thereof is formed in a straight shape. The plate spring 32 is supported by the stationary blade frame 33, biases the stationary blade 31 in a direction of an arrow b of FIG. 4, and biases the lock member 35 in a direction of an arrow f of FIG. 4. The plate spring 32 also functions as a moving member for moving the stationary blade frame 33 with respect to the main frame 13 by a reaction force of the biasing force.

Further, as shown in FIG. 4, the stationary blade frame 33 for supporting the stationary blade 31 has, as positioning means for positioning the stationary blade frame 33 with respect to the main frame 13, positioning grooves 33*c* engaging with a positioning protruding portion 13*b* for performing positioning with respect to the main frame 13, and engagement grooves 33*a* with which a lock arm 35*a* of the lock member 35 described later is engaged, the positioning grooves 33*c* and the engagement grooves 33*a* being formed in side plates of the stationary blade frame 33. Further, the side plate of the stationary blade frame 33 is formed with an elongated hole 33*b* by which a rotation shaft 22*a* of the platen roller 22 of the printing device 11 is supported. The elongated hole 33*b* moves with respect to the rotation shaft 22*a*, thereby making the stationary blade frame 33 movable in a predetermined movable range with respect to the main frame 13.

Further, as shown in FIG. 4, the sheet guide 34 is disposed on an upstream side in a transporting direction of the sheet material 5 with respect to the stationary blade 31 with a gap, in which the movable blade 41 can enter, being formed between the stationary blade 31 and the sheet guide 34. The sheet guide 34 is formed with a guide surface 34*a* with which the sheet material 5 which is transported comes into slide contact. Further, when the movable blade 41 is moved with respect to the stationary blade 31 to allow the sheet material 5 to be cut, the sheet guide 34 supports the sheet material 5 over the blade edge of the stationary blade 31 and the guide surface 34*a* thereof, thereby suppressing relief of the sheet material 5 pressed by the movable blade 41 and preventing the sheet material 5 from being bent. Therefore, by the sheet guide 34, the sheet material 5 is cut smoothly.

Figure 8:
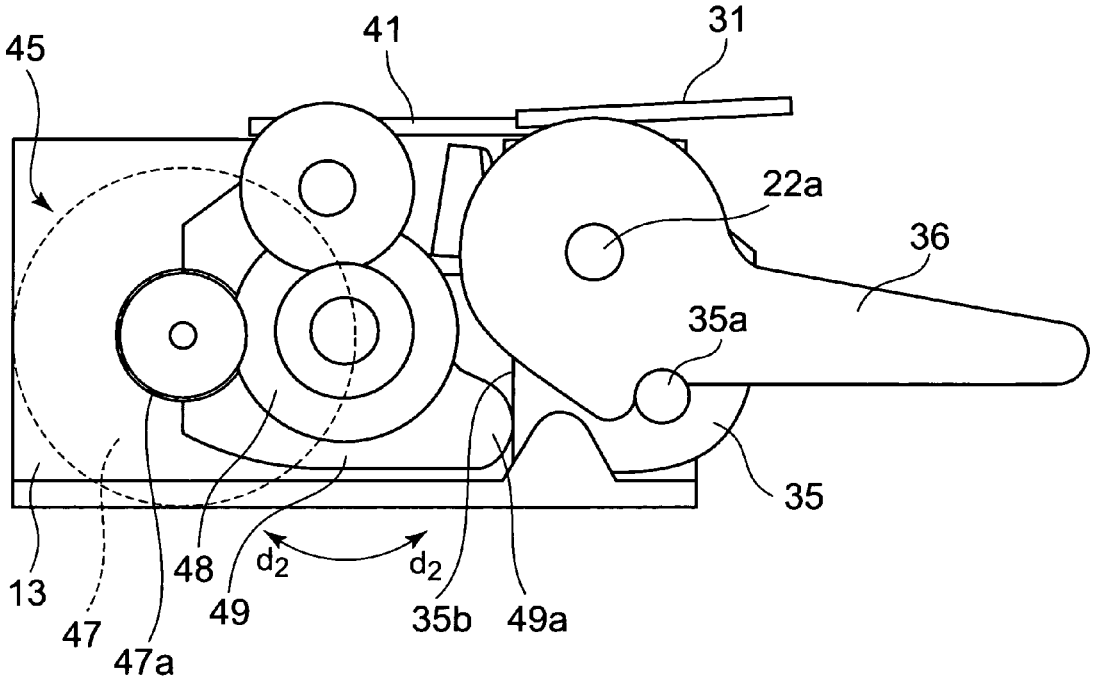
FIG. 8 is a side view showing a state where a drive motor and a gear train of a cutter drive mechanism are engaged with each other.

Further, as shown in FIG. 4, the lock member 35 of the stationary blade unit 26 has a lock arm 35*a* engaged with the stationary blade frame 33. Further, as shown in FIGS. 5 and 8, the lock member 35 is formed with a position regulating surface 35*b* for regulating a position of a swing frame 49 of a cutter drive mechanism 45 described later. The release lever 36 of the stationary blade unit 26 is integrated with and fixed to the lock member 35 and is provided so as to be rotatable about the rotation shaft 22*a* of the platen roller 22.

The movable blade unit 27 of the sheet cutting device 12 includes, as shown in FIGS. 1 and 2, the movable blade 41 which parallelly moves in directions of being closer to and spaced apart from the stationary blade 31, that is, directions of arrows c1 and c2 of FIG. 2, a movable blade biasing spring (not shown) for biasing the movable blade 41 in the direction of the arrow c2, a movable frame (not shown) for moving the movable blade 41, a movable blade frame 43 for supporting the movable blade 41 and the movable frame, and the cutter drive mechanism 45 connected to the movable frame, for parallelly moving the movable blade 41 in the directions of the arrows c1 and c2 with respect to the stationary blade 31.

As shown in FIG. 2, the movable blade 41 of the movable blade unit 27 is formed of a flat plate-like material and has the blade edge formed in a substantially V shape. The movable blade frame 43 is fixed to the main frame 13.

Further, as shown in FIG. 2, the cutter drive mechanism 45 of the movable blade unit 27 is provided by being supported by the side plate of the main frame 13. The cutter drive mechanism 45 includes a cutter drive motor 47 and a gear train 48 for transmitting a driving force by the cutter drive motor 47 to the movable blade 41.

Figure 9:
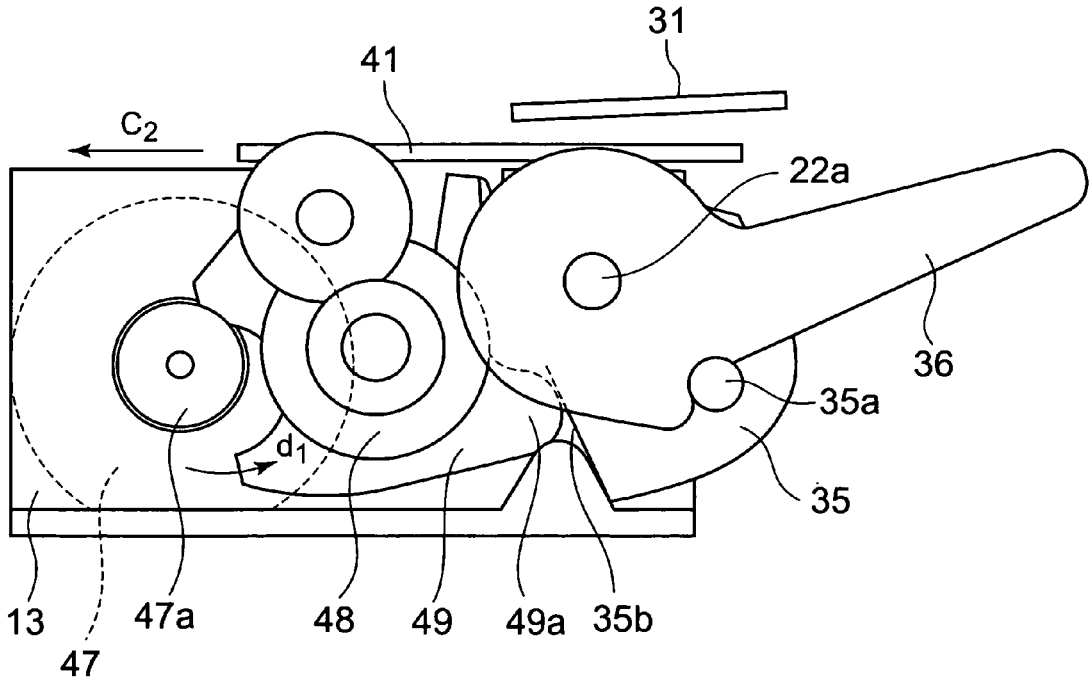
FIG. 9 is a side view showing a state where the drive motor and the gear train of the cutter drive mechanism are disengaged with each other.

Further, the cutter drive mechanism 45 includes, as shown in FIGS. 8 and 9, as transmission releasing means, the swing frame 49 capable of swinging the gear train 48 in directions of arrows d1 and d2 of FIG. 8 with respect to a pinion 47*a* of the cutter drive motor 47, and a swing frame biasing spring (not shown) for biasing the swing frame 49 so that the swing frame 49 swings in such direction of the arrow d1 that the gear train 48 is spaced apart from the cutter drive motor 47.

Further, the swing frame 49 is formed with an abutting portion 49*a* which is to be abutted on the position regulating surface 35*b* of the lock member 35. The abutting portion 49*a* is abutted on the lock member 35, thereby regulating a position of the gear train 48 with respect to the pinion 47*a* of the cutter drive motor 47.

The main frame 13 for supporting the above-mentioned printing device 11 and the sheet cutting device 12 is formed with, as positioning means for positioning the stationary blade frame 33 with respect to the main frame 13, as shown in FIG. 5, a support groove 13*a* for rotatably supporting the rotation shaft 22*a* of the platen roller 22, the positioning protruding portion 13*b* engaged with the positioning groove 33*c* of the stationary blade frame 33 of the stationary blade unit 26, and a lock groove 13*c* engaged with the lock arm 35*a* of the lock member 35.

Figure 6:
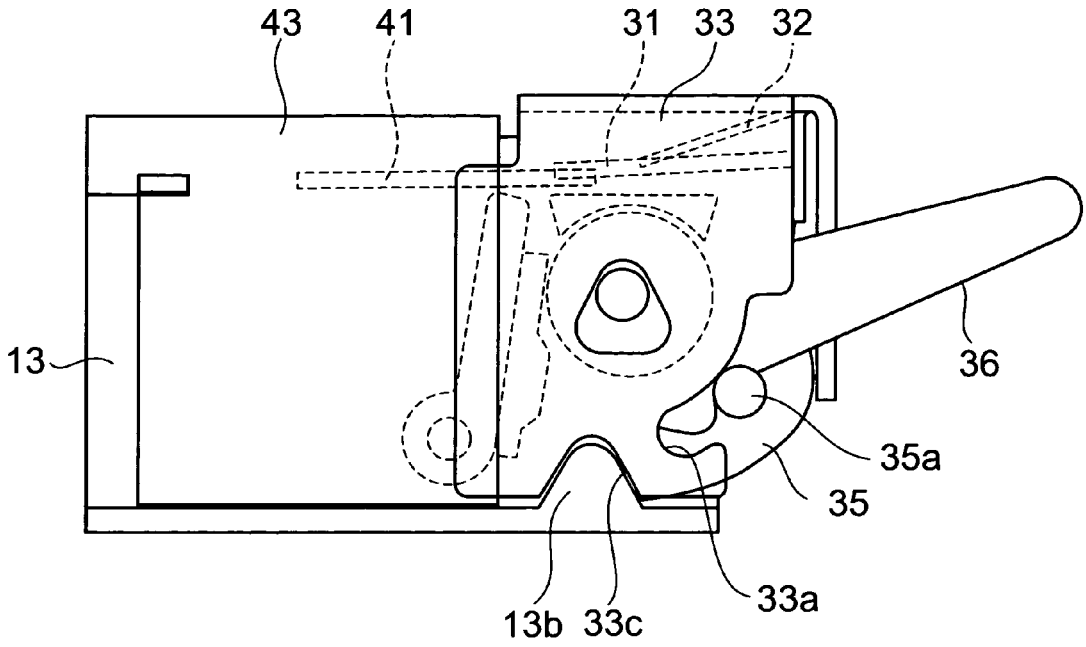
FIG. 6 is a see-through side view showing a state where regulation of a position of the stationary blade frame by a lock member is released.
Figure 7:
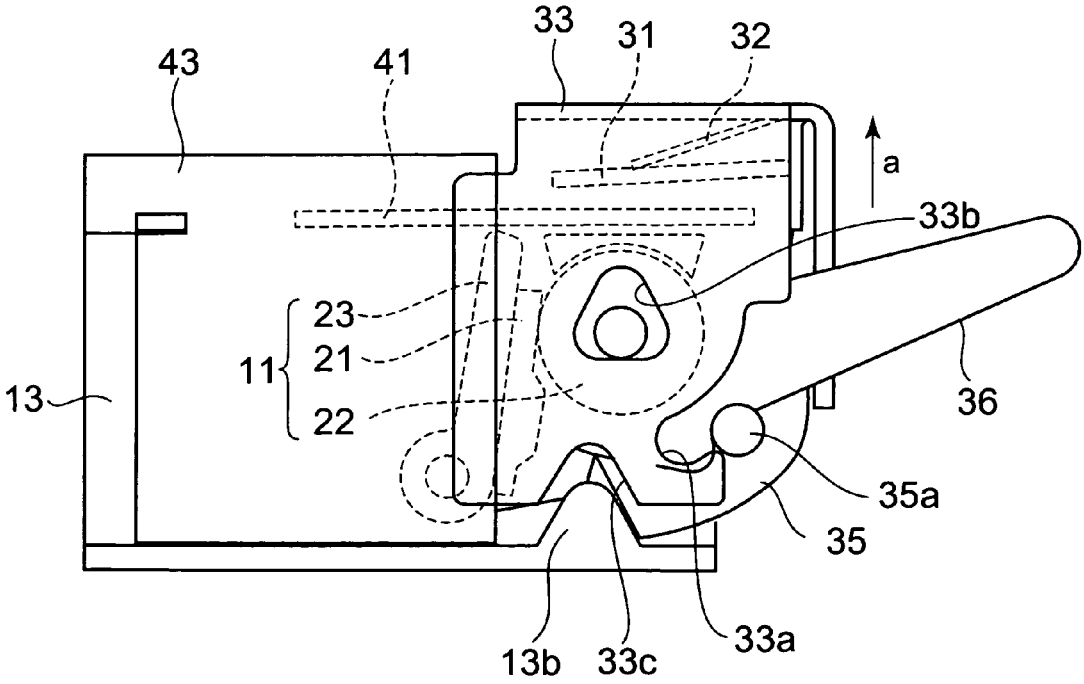
FIG. 7 is a see-through side view showing a state where the stationary blade unit is moved with respect to the main frame.

With regard to the sheet cutting device 12 included in the printer 1 structured as described above, an operation in which the stationary blade unit 26 is attached to and detached from the movable blade unit 27 side is described. FIG. 4 is a see-through side view showing a state where the stationary blade unit 26 is positioned with respect to the main frame 13. FIG. 5 is a see-through side view showing a state where the stationary blade unit 26 is removed from the main frame 13. FIG. 6 is a see-through side view showing a state where regulation of a position of the stationary blade frame 33 by the lock member 35 is released. FIG. 7 is a see-through side view showing a state where the stationary blade unit 26 is moved with respect to the main frame 13. FIG. 8 is a side view showing a state where the cutter drive motor 47 and the gear train 48 of the cutter drive mechanism 45 are engaged with each other. FIG. 9 is a side view showing a state where the cutter drive motor 47 and the gear train 48 of the cutter drive mechanism 45 are disengaged with each other.

In the sheet cutting device 12, with respect to the sheet material 5 supported over the blade edge of the stationary blade 31 and the guide surface 34*a* of the sheet guide 34, the movable blade 41 is moved in the direction of the arrow c1, thereby allowing the sheet material 5 to be cut. However, due to unexpected paper jam, during cutting of the sheet material 5, the movable blade 41 is disabled, and the sheet cutting device 12 comes to standstill in a state where the movable blade 41 and the stationary blade 31 are engaged with each other.

In this case, it is necessary that the sheet material 5 inhibiting the operation of the movable blade 41 be removed and the movable blade 41 be returned to the cutting stand-by position spaced apart from the stationary blade 31.

First, in the sheet cutting device 12, by rotating the release lever 36 in a direction of an arrow e of FIG. 4, the lock member 35 is rotated, the lock arm 35*a* of the lock member 35 is moved from the lock groove 33*a* of the stationary blade frame 33 and the lock groove 13*c* of the main frame 13, and as shown in FIG. 6, the lock arm 35*a* of the lock member 35 is released from the lock grooves 13*c* and 33*a*.

In a state where the lock arm 35*a* of the lock member 35 is detached from the lock groove 33*a* of the stationary blade frame 33, the elongated hole 33*b* in the side plate of the stationary blade frame 33 becomes movable in the direction of the arrow a with respect to the rotation shaft 22*a* of the platen roller 22 supported by the main frame 13.

When the stationary blade frame 33 becomes movable with respect to the main frame 13, by a reaction force caused by the biasing force of the plate spring 32 which brings the stationary blade 31 into press contact with the movable blade 41, as shown in FIG. 7, the stationary blade frame 33 is automatically moved in the direction of the arrow a with respect to the main frame 13. The stationary blade frame 33 is moved with respect to the main frame 13, thereby allowing the stationary blade 31 supported by the stationary blade frame 33 to be moved to the release position in which the stationary blade 31 is spaced apart from the movable blade 41 to release the press contact state therebetween. As described above, in the sheet cutting device 12, with the position of the platen roller 22 on the printing device 11 side being retained, the stationary blade 31 is moved to the release position with respect to the movable blade 41.

Further, by rotating the lock member 35, together with the movement of the lock member 35, the swing frame 49 whose position has been regulated by the position regulating surface 35*b* of the lock member 35 is swung by an elastic force of the swing frame biasing spring in the direction of the arrow d1 as shown in FIG. 9. By swinging the swing frame 49 in the direction of the arrow d1, the pinion 47*a* of the cutter drive motor 47 and the gear train 48 are disengaged from each other, thereby disconnecting the cutter drive motor 47 and the movable blade 41 from each other.

Owing to the release of the press contact state between the movable blade 41 and the stationary blade 31 by spacing the stationary blade 31 away from the movable blade 41, and the disconnection of the cutter drive motor 47 and the movable blade 41 from each other, the movable blade 41 becomes movable and is moved to the direction of the arrow c2 by the biasing force of the movable blade biasing spring to be moved to the cutting stand-by position spaced apart from the stationary blade 31. The movable blade 41 is moved to the stand-by position as described above, thereby making it possible to move the platen roller 22 to the direction of the arrow a without causing the platen roller 22 to impact on the movable blade 41.

At last, as shown in FIGS. 3 and 5, the stationary blade unit 26 is moved to the direction of the arrow a, thereby being removed from the main frame 13, and the platen roller 22 supported by the stationary blade frame 33 is spaced apart from the print head 21.

Note that, according to the sheet cutting device 12 according to this embodiment, while as shown in FIG. 5, a separation structure is applied, in which the stationary blade unit 26 is removed by being separated from the main frame 13, a structure in which the stationary blade unit 26 comes to standstill in the state shown in FIG. 8, that is, a so-called stationary structure, in which the stationary blade unit 26 is not separated from the main frame 13, may be applied.

Next, in a case where the stationary blade unit 26 which has been removed from the main frame 13 is attached to the main frame 13, an operation opposite to the above-mentioned operation is performed. First, when the stationary blade unit 26 is attached to the main frame 13, the rotation shaft 22*a* of the platen roller 22 is supported by the support groove 13*a* of the main frame 13 and the positioning grooves 33*c* of the stationary blade frame 33 is engaged with the positioning protruding portion 13*b* of the main frame 13. As a result, the stationary blade frame 33 is positioned in a predetermined position in a horizontal direction, that is, the direction indicated by the arrows c1 and 2*c* to be attached to the main frame 13.

Subsequently, when the stationary blade frame 33 is operated by being pushed in with respect to the main frame 13 against the biasing force of the plate spring 32, the release lever 36 is rotated in the direction of the arrow f by the biasing force of the plate spring 32 to allow the lock arm 35*a* of the lock member 35 to be engaged with the lock groove 33*a* of the stationary blade frame 33 and the lock groove 13*c* of the main frame 13. As a result, a state of the sheet cutting device 12 becomes a locking state where the stationary blade frame 33 is positioned in a predetermined position in a vertical direction, that is, the direction of the arrow a with respect to the main frame 13 and the position of the stationary blade frame 33 positioned with respect to the main frame 13 is regulated.

As described above, in the sheet cutting device 12 included in the printer 1, in a case where the movable blade 41 is disabled during the cutting of the sheet material 5, the stationary blade frame 33 supporting the stationary blade 31 is moved with respect to the main frame 13 while retaining the state where the print head 21 is brought into press contact with the platen roller 22. As a result, the stationary blade 31 and the movable blade 41 are spaced apart from each other, the stationary blade 31 is moved to the release position in which the press contact state between the movable blade 41 and the stationary blade 31 is released, and the movable blade 41 and the cutter drive mechanism 45 are disconnected from each other. Consequently, the movable blade 41 can be easily moved to the cutting stand-by position spaced apart from the stationary blade 31 side, thereby smoothly removing the sheet material 5 from a periphery of the movable blade 41.

Further, according to the sheet cutting device 12, a moving direction of the stationary blade unit 26 is not limited. Accordingly, restriction on an opening and closing direction of a cover (not shown) covering the stationary blade unit 26 is eliminated.

Further, in the sheet cutting device 12, by a reaction force caused by the biasing force of the plate spring 32 for bringing the stationary blade 31 into press contact with the movable blade 41, the stationary blade frame 33 is moved with respect to the main frame 13, thereby moving the stationary blade 31 to the release position. Accordingly, there is no need of separately providing a moving mechanism for moving the stationary blade 31, whereby the structure is simplified.

In addition, in the related art sheet cutting device, in order to position the stationary blade in the predetermined position with respect to the movable blade, it is necessary that the stationary blade be pressed to the predetermined position by the cover or the like, for example, and it is necessary that the cover or the like be provided separately from the sheet cutting device. On the other hand, in the sheet cutting device 12 of this embodiment, the stationary blade frame 33 is positioned with respect to the main frame 13, thereby positioning the stationary blade 31 in the predetermined position with respect to the movable blade 41, so the sheet material 5 can be cut by the sheet cutting device 12 alone.

Briefly speaking, according to the sheet cutting device 12, before moving the printing device 11, the movable blade 41 is easily and reliably moved to the cutting stand-by position to increase a movable direction of the printing device 11, to enable positioning of the stationary blade frame 33 with respect to the main frame 13, and to enable cutting in a printer which does not require a retaining mechanism for the stationary blade frame 33, including a separate member, whereby enlargement of application of the sheet cutting device and downsizing of the sheet cutting device as a whole can be achieved.

Further, in the sheet cutting device 12 according to the above embodiment, there is adopted the structure in which the stationary blade frame 33 is moved with respect to the main frame 13 to which the movable blade frame 43 is fixed. However, in contrast to this structure, there may be adopted a structure in which the movable blade frame 43 is moved with respect to the main frame 13 to which the stationary blade frame 33 is fixed, and the same effect is obtained. In a case of the structure in which the movable blade frame 43 is provided so as to be movable with respect to the main frame 13, the movable blade 41 is disposed on a downstream side in a transporting direction of the sheet material 5 with respect to the stationary blade 31.

Further, in the sheet cutting device of this embodiment, there is adopted the structure in which the platen roller is supported by the stationary blade frame, and as a matter of course, there may be adopted a structure in which the print head side is supported by the stationary blade frame.

Note that, the sheet cutting device according to the present invention is not limited to be applied to the separation structure in which the stationary blade frame is separated from the main frame as in the embodiment, and as a matter of course, the sheet cutting device may be applied to the stationary structure in which the stationary blade frame is not separated from the main frame. Even with the stationary structure, as in the case with the separation structure according to the above embodiment, the stationary blade can be easily moved to the release position. Accordingly, even in the case of taking any one of the separation structure and the stationary structure, in the sheet cutting device according to the present invention, the stationary blade and the stationary blade frame are structured in common with each other, thereby reducing manufacturing costs.

What is claimed is:

1. A printing device comprising:

a platen roller having a platen roller shaft;

a print head for performing printing on a sheet material; and a sheet cutting device for cutting the sheet material on which printing has been performed, the sheet cutting device comprising:

a stationary blade disposed on a downstream side in a transporting direction of the sheet material with respect to the print head;

a movable blade mounted to undergo movement to a position close to and spaced apart from the stationary blade for cutting the sheet material in a pressing contact state with respect to the stationary blade, the stationary blade being disposed on the downstream side in the transporting direction of the sheet material with respect to the movable blade;

drive means for moving the movable blade with respect to the stationary blade;

a stationary blade frame for supporting the stationary blade, the stationary blade frame having elongated holes at respective ends thereof supporting respective ends of the platen roller shaft;

a movable blade frame for supporting the movable blade, a main frame movably supporting the stationary blade and non-movably supporting the movable blade frame; and releasing means disposed in the stationary blade frame and movable to first and second positions for releasing the stationary and movable blades;

wherein in the first position of the releasing means, the movable and stationary blades are in the pressing contact state, the platen roller is in contact with the print head, and the ends of the platen roller shaft are disposed adjacent to one end of the respective elongated holes of the stationary blade frame; and wherein in the second position of the releasing means, the movable and stationary blades are moved out of the pressing contact state, the platen roller is in contact with the print head, and the ends of the platen roller shaft are disposed adjacent to the other end of the respective elongated holes of the stationary blade frame.

2. A printing device according to claim 1; further comprising a moving member for moving the stationary blade frame with respect to the main frame.

3. A printing device according to claim 2; wherein the moving member comprises a pressing contact member for bringing the stationary blade into pressing contact with the movable blade.

4. A printing device according to claim 1; wherein each of the main frame and the stationary blade frame is provided with positioning means for positioning the stationary blade frame with respect to the main frame.

5. A printing device according to claim 4; further comprising a lock member for regulating a position of the stationary blade frame which is positioned by the positioning means with respect to the main frame.

6. A printing device according to claim 5; further comprising transmission release means for disconnecting the movable blade and the drive means from each other when the stationary blade frame is moved with respect to the main frame; wherein the transmission release means interlocks with movement of the lock member.

7. A printing device according to claim 1; further comprising transmission releasing means for disconnecting the movable blade and the drive means from each other when the stationary blade frame is moved with respect to the main frame.

8. A printing device according to claim 7; wherein drive means comprises a drive motor and a gear train rotated by the drive motor for moving the movable blade; and wherein the transmission release means moves the gear train with respect to the drive motor, thereby disengaging the drive motor and the gear train from each other.

9. A printing device according to claim 1; further comprising a sheet guide provided on an upstream side in the transporting direction of the sheet material and having a gap in which the movable blade can enter, the gap being formed between the stationary blade and the sheet guide for supporting the sheet material.

10. A printing device according to claim 1; wherein the stationary blade frame is detachably provided to the main frame.

11. A printing device comprising:

a platen roller having a platen roller shaft;

a print head for performing printing on a sheet material; and a sheet cutting device for cutting the sheet material on which printing has been performed, the sheet cutting device comprising:

a stationary blade disposed on a downstream side in a transporting direction of the sheet material with respect to the print head;

a movable blade mounted to undergo movement to a position close to and spaced apart from the stationary blade for cutting the sheet material in a pressing contact state with respect to the stationary blade, the movable blade being disposed on the downstream side in the transporting direction of the sheet material with respect to the stationary blade;

drive means for moving the movable blade with respect to the stationary blade;

a stationary blade frame for supporting the stationary blade, the stationary blade frame having elongated holes at respective ends thereof supporting respective ends of the platen roller shaft;

a movable blade frame for supporting the movable blade, a main frame movably supporting the movable blade and non-movably supporting the stationary blade frame; and releasing means disposed in the movable blade frame and movable to first and second positions for releasing the stationary and movable blades;

wherein in the first position of the releasing means, the movable and stationary blades are in the pressing contact state, the platen roller is in contact with the print head, and the ends of the platen roller shaft are disposed adjacent to one end of the respective elongated holes of the stationary blade frame; and wherein in the second position of the releasing means, the movable and stationary blades are moved out of the pressing contact state, the platen roller is in contact with the print head, and the ends of the platen roller shaft are disposed adjacent to the other end of the respective elongated holes of the stationary blade frame.

12. A printing device comprising:

a platen roller having a platen roller shaft;

a print head for performing printing on a sheet material; and a sheet cutting device for cutting the sheet material on which printing has been performed, the sheet cutting device comprising:

a stationary blade disposed on a downstream side in a transporting direction of the sheet material with respect to the print head;

a movable blade mounted to undergo movement to a position close to and spaced apart from the stationary blade for cutting the sheet material in a pressing contact state with respect to the stationary blade, one of the stationary blade and the movable blade being disposed on the downstream side in the transporting direction of the sheet material with respect to other of the stationary blade and the movable blade;

a stationary blade frame for supporting the stationary blade, the stationary blade frame having elongated holes at respective ends thereof supporting respective ends of the platen roller shaft;

a movable blade frame for supporting the movable blade;

a main frame movably supporting one of the stationary blade frame and the movable blade frame and non-movably supporting the other of the stationary blade frame and the movable blade frame; and a release mechanism disposed in one of the stationary blade frame and the movable blade frame and movable to first and second positions to release the stationary and movable blades;

wherein in the first position of the release mechanism, the movable and stationary blades are in the pressing contact state, the platen roller is in contact with the print head, and the ends of the platen roller shaft are disposed adjacent to one end of the respective elongated holes of the stationary blade frame; and wherein in the second position of the release mechanism, the movable and stationary blades are moved out of the pressing contact state, the platen roller is in contact with the print head, and the ends of the platen roller shaft are disposed adjacent to the other end of the respective elongated holes of the stationary blade frame.

* * * * *